United States Patent [19]

Swallert

[11] Patent Number: 4,744,469

[45] Date of Patent: May 17, 1988

[54] MAGNETIC CUTLERY SORTING MACHINE

[76] Inventor: Sven A. Swallert, 11, rue Michel Chauvet, CH-1208 Geneva, Switzerland

[21] Appl. No.: 901,686

[22] Filed: Aug. 29, 1986

[30] Foreign Application Priority Data

Aug. 30, 1985 [SE] Sweden ..... 8504064

[51] Int. Cl.[4] ..... B07C 9/00

[52] U.S. Cl. ..... 209/636; 209/656; 209/661; 209/926

[58] Field of Search ..... 209/926, 907, 636, 656, 209/659, 660, 661; 198/690.1, 803.6, 679, 681

[56] References Cited

U.S. PATENT DOCUMENTS

| | | | |
|---|---|---|---|
| 3,498,452 | 3/1970 | Aronstein et al. | 209/656 |
| 3,545,613 | 12/1970 | Nystuen | 209/926 |
| 3,938,533 | 2/1976 | Richard | 209/926 |
| 4,262,805 | 4/1981 | Bankes et al. | 209/907 |
| 4,356,905 | 11/1982 | Large | 198/803.6 |

FOREIGN PATENT DOCUMENTS

| | | | |
|---|---|---|---|
| 835738 | 3/1970 | Canada | 209/661 |
| 873869 | 7/1961 | United Kingdom | 209/659 |
| 753495 | 8/1980 | U.S.S.R. | 209/659 |

*Primary Examiner*—Joseph F. Peters, Jr.
*Assistant Examiner*—Thomas J. Brahan
*Attorney, Agent, or Firm*—Sughrue, Mion, Zinn, Macpeak and Seas

[57] ABSTRACT

A machine for sorting rod-shaped articles 3–6 of magnetic material in accordance with their respective lengths, such as knives, forks, and spoons, includes a transporting arrangement 1 which comprises magnetic collecting rods 2 which attract magnetically the ends of respective items and carry them past a plurality of underlying magnetic delivery rods 11–14 with the items hanging vertically. The delivery rods are spaced at a progressively diminishing distance from the movement path of the collecting rods so that the lower ends of the longest items 3 come into contact with the first delivery rod 11 and are drawn loose from a collecting rod 2 thereby, this procedure being repeated at each classifying station until the shortest item 6 comes into contact with the last, commensurately spaced delivery rod 14 and is drawn loose thereby.

5 Claims, 1 Drawing Sheet

MAGNETIC CUTLERY SORTING MACHINE

BACKGROUND OF THE INVENTION

The present invention relates to a machine for sorting rod-shaped items or articles made of a magnetic or magnetizable material into a given number of length-dependent categories or classifications, preferably items of cutlery such as knives, forks and spoons of mutually different lengths.

Attempts have been made in the art to construct for this purpose machines which incorporate a conveyor path on which the articles are advanced to an apertured plate in which the apertures increase in length stepwise in the direction of travel of the articles, these increases in aperture length corresponding to the particular classifications or categories into which the articles are to be sorted. Thus, the shortest articles fall through the first classifying aperture in the plate and the longest articles through the last aperture, whereas the articles of intermediate length fall through apertures located between the first and the last aperture, in dependence on length. Despite the simplicity of such classifying machines, however, they have been found unreliable in practice and do not have a satisfactory throughput capacity.

Consequently there has long been a need for quick-working, reliable sorting or classifying machines, particularly for sorting cutlery washed in a dish-washing machine, such sorting procedures being carried out manually despite the drawbacks associated therewith with regard to hygiene and working environmental problems.

The objective of the present invention is to provide a machine which satisfies this need. This objective is achieved with a machine constructed in accordance with the invention and having characteristic features set forth in the following claims.

SUMMARY OF THE INVENTION

The invention is based on the realization that the necessary handling of the various items or articles while simultaneously measuring the lengths thereof is best effected with the items hanging vertically, with the upper ends thereof held magnetically by a horizontally moving magnetic collecting element. The lower ends of respective items will thus move in respective paths at mutually different levels which correspond to a plurality of sorting categories or classifications, and it is therefore a simple matter to determine the category to which each individual item belongs. It may appear a relatively simple matter to deliver the items selectively to respective stations with the aid of conventional means, such as individual level sensors and means for temporarily demagnitizing the collecting elements. Such arrangements, however, are unreliable when used in present day environmental conditions, such as conditions of high humidity, moisture and steam, and on occasions when the items to be classified are packed very closely together. An essential advantage afforded by the invention is obtained by the particular arrangement of the magnetic delivery elements, which retrieve the correct item with absolute reliability at the appropriate delivery station, irrespective of the closeness of respective items hanging from the collecting elements.

BRIEF DESCRIPTION OF THE DRAWINGS

The invention will now be described in more detail with reference to the accompanying drawing which illustrates an exemplifying embodiment of a cutlery sorting or classifying machine according to the invention, and in which.

DETAILED DESCRIPTION OF THE PREFERRED EMBODIMENTS

Figure 1:
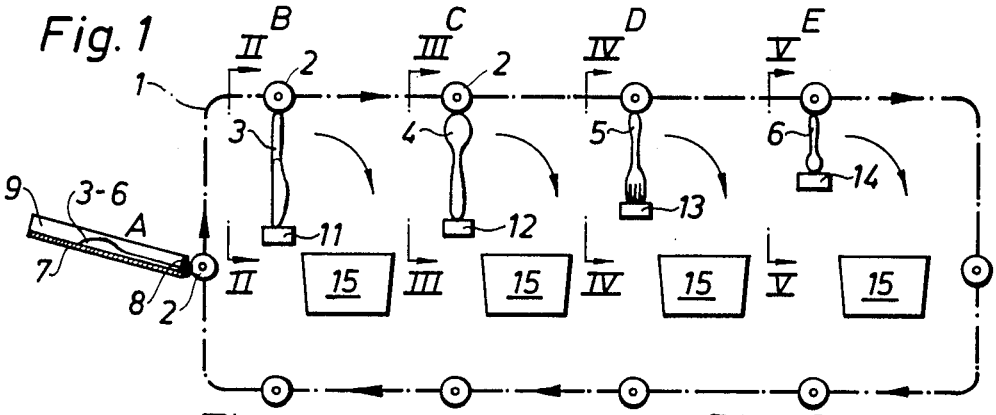
FIG. 1 is a schematic side view of the machine.

The machine illustrated in FIG. 1 comprises an endless conveyor path or belt 1 which is provided with permanently magnetized collecting elements in the form of rods 2. The rods, or cylinders 2, are arranged to move clockwise along a rectangular path in mutually spaced relationship, with the spacing between adjacent rods being slightly greater than the length of the longest item, the knives 3, to be sorted in accordance with length. Remaining items of cutlery in a decreasing order of length may include serving spoons 4, forks 5, and tea spoons 6. The devices used to drive and control the rods 2 along the endless path 1 are of a conventional kind and need not therefore be described and illustrated here. Incorporated in the upwardly moving part of the endless path or belt 1 is a collecting station A, while delivery stations B, C, D and E for receiving knives 3, serving spoons 4, forks 5, and teaspoons 6 are located along the upper horizontal run of the endless belt. The various items of cutlery are delivered to the machine on an inclined plate 7 flanked by upstanding side plates 9 which guide the items of cutlery, orientated with their longitudinal axes in the direction of movement, until stopped with one end against a thin plastic bar 8. The bar 8 is located so that the magnetic rods 2, which function as collectors, slide along the outer surface of the bar. Since both ends of each item of cutlery are magnetic, it is unimportant which end of said item rests against the bar 8. All items of cutlery that rest with one end thereof against the bar 8 are attracted magnetically by a rod 2 as it passes by, so as to be lifted by one end and hang vertically from the collecting rod as it moves away from the bar.

Naturally, the bar 8 will slightly impair the attractive force of the magnetic rods 2 on the ends of respective items of cutlery during the actual moment of lifting said item. This can be overcome, however, by providing the bar with narrow upwardly extending fingers which permit direct contact between a magnetic rod 2 and the ends of respective items of cutlery at the precise moment of lifting said items, therewith to afford a camming action.

Each of the delivery stations B–E has arranged therein respective magnetic removal or delivery elements 11–14 which have the form of magnetic rods of the same length as the magnetic rods 2 and which are spaced from the under surfaces of the rods 2 when said rods are located immediately above the rods 11–14, this spacing being equal to or some millimeters shorter than the length of the items of cutlery 3–6 in the aforesaid classifying order, i.e. the distance between the mutually opposed rods 2 and 11–14 decreases from a distance commensurate with the length of knives 3 to a distance commensurate with the spoons 6.

Collecting containers 15 are placed beneath the delivery elements 11–14 and to one side thereof as seen in the upstream direction of the path or belt 1. The containers 15 may alternatively be replaced with transverse conveyors or sloping chutes, or equivalent devices.

Figure 6:
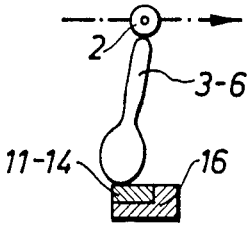
FIGS. 6 and 7 are respective cross-sectional views of a collecting element and a delivery element during transfer of an item to a collecting container in a delivery station.
Figure 7:
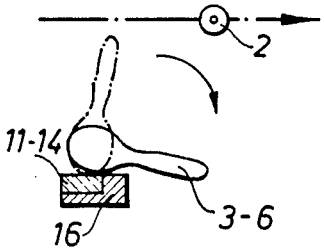

The magnetic attraction force exerted by the magnetic rods 11–14 is greater than that exerted by the magnetic rods 2, so that when the depending end of an item of cutlery carried by a rod 2 contacts an underlying rod 11–14, depending upon the length of said item, this item of cutlery becomes positively attached to the magnetic rod 11–14 and is consequently wrenched from the rod 2 of weaker magnetism as said rod moves to the right in FIG. 1 along said path 1. As a result the aforesaid item of cutlery will swing clockwise with a momentum sufficient to break the grip of the relevant magnetic rod 11–14. In order to render it impossible for an item of cutlery to remain attached to a particular magnetic rod 11–14, means may be provided for momentarily demagnetizing the rods, either electrically or mechanically, during each delivery sequence or during given delivery sequences. A simpler but equally effective solution to this problem is illustrated in FIGS. 6 and 7. In this embodiment each magnetic delivery rod 11–14 is provided on its underside, and to the right as seen in the drawing, with a partial wrap 16 of non-magnetic material. The under part of the wrap 16 prevents upwardly bouncing cutlery items from becoming attached to an adjacent magnetic rod while the right-hand edge of the wrap serves as an effective dislodging element which forces the attracted end of said cutlery item away from the actual magnetic rods 11–14, as illustrated in FIG. 7.

Figure 2:
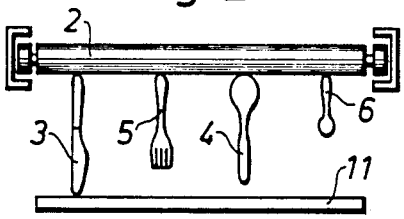
FIGS. 2–5 are respective sectional views taken on the lines II—II to V—V in FIG. 1.

The manner in which the machine operates will be seen from FIGS. 2–5. As illustrated in FIG. 2, in delivery station B the magnetic collecting rod 2 has depending therefrom a number of items of cutlery, which may comprise all of the aforesaid four different categories. Only the knives 3 have a length sufficient to be attracted by the underlying delivery rod 11 and drawn free from the collecting rod 2 and dropped into the associated container 15.

Figure 3:
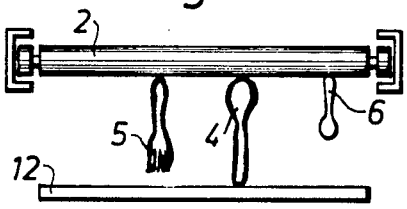

The collecting rods 2 move further to the delivery station C, FIG. 3, where only serving spoons, of sufficient length to be magnetically attracted and drawn loose from the magnetic rod 2 by the underlying delivery rod or element 12, are thrown into the appropriate container 15.

Figure 4:
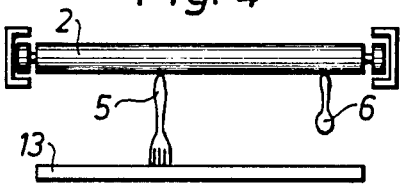

In the delivery station D, FIG. 4, only the forks have a length sufficient to be attracted and pulled loose by the delivery rod or element 13 and thrown into the appropriate container 15.

Figure 5:
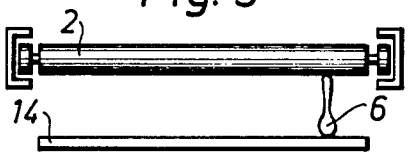

Finally, only the tea spoons 6 remain when the collecting rod 2 arrives at delivery station E, FIG. 5, these spoons being pulled loose by the underlying rod or element 14 and delivered to the appropriate container 15.

It will be appreciated that the delivery stations B–E can be readily extended to include sorting stations for other items of cutlery, such as dessert spoons, butter knives, etc. The only necessity in this regard is that there is a difference in length between the items of each category to be sorted. This length difference can be as small as from two to three millimeters, since the delivery rods or elements 11–14 collecting the items from the rods 2 can be positioned and regulated with a high degree of accuracy in relation to the movement path of the collecting rods 2.

The magnetic collecting rods 2 can be driven at high speed, so as to achieve a high sorting capacity.

Figure 8:
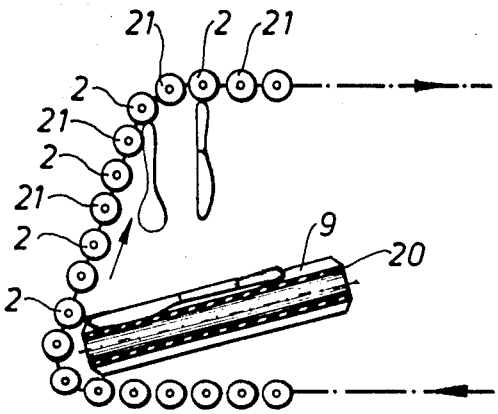
FIG. 8 is a part view similar to FIG. 1, illustrating schematically a modified machine incorporating an internally located delivery station.

The sorting capacity can be increased still further by means of the embodiment illustrated in FIG. 8. In this embodiment the various items of cutlery are fed to the collecting station A from a location within the endless conveyor path 1 instead of from a location external of said path, the cutlery in this embodiment being advanced on an inclined endless conveyor belt 20. The magnetic collecting rods of this embodiment can be placed much closer together, optionally separated by intermediate non-magnetic spacer rods 21, since in this embodiment the items of cutlery need not pass between the magnetic rods 2. The upwardly rising part of the conveyor path 1, however, must slope rearwardly to some extent, as shown in FIG. 8, so that individual items of cutlery can be lifted by a magnetic collecting rod 2 to a vertical position without coming into contact with an underlying rod 2. Consequently in this embodiment the respective items of cutlery will be displaced rearwardly during the initial stage of this lifting movement, although to no disadvantage.

It will be understood that the invention is not restricted to machine constructions for sorting items of cutlery and that the principles of the invention can be used in conjunction with other sorting machines and apparatus, such as machines for sorting machine components, fittings, etc. made of a magnetic or magnetizable material.

I claim:

1. A machine for sorting substantially rod-shaped articles (3–6) of magnetic material in accordance with respective lengths thereof, such as knives, forks and spoons of mutually different lengths, comprising:

(a) means (7; 20) for aligning the articles in a given direction at a collecting station (A);

(b) a conveyor arrangement (1) disposed closely proximate the collecting station and comprising a plurality of spaced magnetic collecting elements (2) for magnetically attracting one end of articles presented hereto at the collecting station and for transporting the articles along a transport path with said articles hanging vertically downwardly from undersides of said collecting elements; and (c) a plurality of delivery stations (B, C, D, E) individually spaced along said transport path, the number of said delivery stations corresponding to the number of different lengths of said articles, and said delivery stations individually incorporating a plurality of magnetic removal elements (11, 12, 13, 14) disposed at progressively shorter distances below the transport path travelled by the undersides of the collecting elements, said distances being no greater than the lengths of the respective articles, and the magnetic force exerted by each removal element being sufficient to draw loose from an overhead collecting element an article coming into contact with a removal element.

2. A machine according to claim 1, wherein each magnetic removal element includes a partial wrap of non-magnetic material (16) against which articles engage when drawn loose from a collecting element and undergo a swinging movement about ends thereof attracted to said magnetic removal elements, such that said non-magnetic material dislodges the attracted ends of the articles from the removal elements.

3. A machine according to claims 1 or 2, wherein the collecting elements (2) are movable along an endless path (1) which surrounds the delivery stations (B–E); and the aligning means (20) is disposed inwardly of an upwardly extending run of the endless transport path.

4. A machine according to claim 3, wherein said upwardly extending run is inclined to the vertical such that it at least partially overlies the aligning means.

5. A machine according to claim 1, wherein the collecting elements and the removal elements comprise elongate rods oriented transverse to the transport path.

* * * * *